US008137882B2

(12) United States Patent
Asano et al.

(10) Patent No.: US 8,137,882 B2
(45) Date of Patent: Mar. 20, 2012

(54) TONER FOR DEVELOPING ELECTROSTATIC IMAGES AND PROCESS FOR PRODUCING THE TONER

(75) Inventors: Shigetoshi Asano, Okayama (JP); Shuzo Nakayama, Okayama (JP); Masashi Ueda, Okayama (JP); Katsutoshi Saito, Okayama (JP); Kazuma Okamura, Okayama (JP)

(73) Assignee: Imex Co., Ltd., Kanagawa (JP)

( * ) Notice: Subject to any disclaimer, the term of this patent is extended or adjusted under 35 U.S.C. 154(b) by 860 days.

(21) Appl. No.: 12/223,195

(22) PCT Filed: Jan. 25, 2007

(86) PCT No.: PCT/JP2007/051657

§ 371 (c)(1),
(2), (4) Date: Jul. 24, 2008

(87) PCT Pub. No.: WO2007/086602

PCT Pub. Date: Aug. 2, 2007

(65) Prior Publication Data

US 2010/0233607 A1 Sep. 16, 2010

(30) Foreign Application Priority Data

Jan. 30, 2006 (JP) ..... 2006-020476

(51) Int. Cl.
*G03G 9/08* (2006.01)

(52) U.S. Cl. ..... 430/108.6; 430/110.4; 430/137.1

(58) Field of Classification Search ..... 430/108.6, 430/110.4, 137.1
See application file for complete search history.

(56) References Cited

U.S. PATENT DOCUMENTS

| | | | | |
|---|---|---|---|---|
| 5,561,019 | A | 10/1996 | Yuasa et al. | |
| 5,702,858 | A | 12/1997 | Yuasa et al. | |
| 5,915,150 | A * | 6/1999 | Kukimoto et al. | 399/149 |
| 6,025,107 | A | 2/2000 | Sekiguchi et al. | |
| 6,383,703 | B1 | 5/2002 | Asano et al. | |
| 6,403,271 | B1 | 6/2002 | Suzuki et al. | |
| 2002/0061455 | A1 * | 5/2002 | Asano et al. | 430/108.1 |
| 2002/0115008 | A1 * | 8/2002 | Suzuki et al. | 430/108.7 |
| 2005/0214668 | A1 * | 9/2005 | Miyakawa et al. | 430/108.7 |

FOREIGN PATENT DOCUMENTS

| | | | |
|---|---|---|---|
| JP | 59-125741 | A | 7/1984 |
| JP | 60-117258 | A | 6/1985 |
| JP | 63-261284 | A | 10/1988 |
| JP | 07-306543 | A | 11/1995 |
| JP | 08-069173 | A | 3/1996 |
| JP | 08-248674 | A | 9/1996 |
| JP | 08-262785 | A | 10/1996 |
| JP | 09-160297 | A | 6/1997 |
| JP | 09-288373 | A | 11/1997 |
| JP | 11-133669 | A | 5/1999 |
| JP | 11-295929 | A | 10/1999 |
| JP | 2001-066820 | A | 3/2001 |
| JP | 2002-107999 | A | 4/2002 |
| JP | 2003-280256 | A | 10/2003 |
| JP | 2005-099323 | A | 4/2005 |
| JP | 2005-274722 | A | 10/2005 |

OTHER PUBLICATIONS

Extended European Search Report and European Search Opinion in EP 07 70 7843.

* cited by examiner

*Primary Examiner* — Mark F Huff
*Assistant Examiner* — Rashid Alam
(74) *Attorney, Agent, or Firm* — Holtz Holtz Goodman & Chick PC

(57) ABSTRACT

A toner for developing electrostatic images which is obtained by melt mixing at least a binder resin and a coloring agent, forming a powder material by pulverizing the obtained mixture after cooling and removing rough particles and fine particles from the formed powder material by classification, wherein inorganic fine particles having a roundness of 1.00 to 1.30, an average of the diameter of primary particles of 0.05 to 0.45 μm and a ratio of a standard deviation to the average of the diameter of primary particles of 0.25 or smaller are added as an external additive, and a process for producing a toner for developing electrostatic images which comprises melt mixing at least a binder resin and a coloring agent, forming a powder material by pulverizing the obtained mixture after cooling, rounding the powder material by a heat treatment and adding the above inorganic fine particles to the rounded powder material. By using the toner, printed images of a high quality can be formed with an excellent transfer rate, suppressed contamination of the charge roller, minimal background and small consumption of the toner.

5 Claims, No Drawings

TONER FOR DEVELOPING ELECTROSTATIC IMAGES AND PROCESS FOR PRODUCING THE TONER

This application is the United States national phase application of International Application PCT/JP2007/051657 filed Jan. 25, 2007.

TECHNICAL FIELD

The present invention relates to a toner for developing electrostatic images and a process for producing the toner. More particularly, the present invention relates to a toner for developing electrostatic images which can form printed images of a high quality with an excellent transfer rate, suppressed contamination of the charge roller, minimal background and small consumption of the toner and a process for producing the toner.

BACKGROUND ART

In the process for forming images utilizing the electronic photography, a photosensitive member is uniformly charged with static electricity, an electrostatic latent image is formed by exposing the uniformly charged member to light so that the electrostatic charge in the exposed portions is dissipated, the latent image is made visible by development by attaching a toner to the electrostatic image, the visualized image is transcribed to a material such as paper, and the transcribed image is fixed by a means for fixing such as heating. The process for the development includes the single component process using a single type of a magnetic or non-magnetic toner and the double component process using two types of powder materials that are a toner and a carrier. The apparatus can be made smaller and simpler in the development in accordance with the single component process. In particular, the development in accordance with the non-magnetic single component process has a characteristic in that color toners providing bright images can be used.

In an apparatus for forming images by development in accordance with the non-magnetic single component process, hydrophobic silica is frequently added to the mother toner particles so that the amount of the electrostatic charge of the toner on the development roller is kept uniform during printing for a long period of time. When silica alone is added externally, background becomes high and the electrostatic charge tends to be unstable under fluctuations in the environment. To overcome these problems, titanium oxide, barium titanate, strontium titanate or magnetite is added externally.

For example, as the negatively charged toner which exhibits excellent stability of the electrostatic charge during repeated uses and under fluctuations in the environment, exhibits excellent property for transcription to paper and reproducibility of black color and can overcome the problem of filming to the photosensitive member and blurred dots during fusing, a negatively charged toner which contains a polyester-based resin as the binder resin and a boron-based chelate compound as the charge control agent and to which hydrophobic silica and a metal titanate are added from the outside in amounts such that the ratio of the amounts by weight of hydrophobic silica to the metal titanate is 5:1 to 1:1.2, is proposed. It is described that the decrease in the amount of electrostatic charge under an environment of a high temperature and a high humidity can be prevented and the stability of electrostatic charge under fluctuations in the environment can be improved by using hydrophobic silica and a metal titanate (Patent Reference 1). However, when hydrophobic silica and a metal titanate are added externally to the mother particles of a toner, aggregates of hydrophobic silica and the metal titanate tend to be formed. The formed aggregates tend to be separated from the toner particles to contaminate members of the printer such as the charge roller and the development roller, and print defects such as background and starvation of filled images tend to arise.

As the non-magnetic single component toner which can provide excellent density of formed images and suppress staining of the background simultaneously, a non-magnetic single component toner which contains 0.2 to 5 parts by weight of barium titanate formed in accordance with the liquid phase process and having a BET specific surface area of 0.5 to 5.0 $m^2/g$ per 100 parts by weight of the toner, is proposed (Patent Reference 2). However, since barium titanate having a BET specific surface area of 0.5 to 5.0 $m^2/g$ has a great particle diameter, barium titanate tends to be separated from the toner particles during repeated printing for a long period of time. Therefore, reproducibility of dots and narrow lines decreases, and the consumption of the toner increases.

Many of the recent apparatuses for forming full color images have a member for intermediate transfer, and transferability of the toner is important. Toner particles having a spherical shape is more advantageous from the standpoint of improving the transfer rate than toner particles having a sharp shape such as toner particles obtained by mixing and pulverization since the toner particles having a spherical shape have smaller areas of contact with the photosensitive member and the member for the intermediate transfer and exhibit smaller force of adhesion.

The toner particles having a spherical shape has another advantage in that the particles can be more uniformly charged. In the development using a non-magnetic single component toner, a thin layer is more easily formed on the development roller and the electrostatic charge is more easily stabilized when the toner particles having a spherical shape are used.

As the toner particles having a spherical shape, toner particles prepared in accordance with the suspension polymerization process or the emulsion polymerization process with aggregation and toner particles prepared by rounding toner particles obtained in accordance with a conventional process of mixing and pulverization by a heat treatment, are known. The toners prepared in accordance with the polymerization process have problems in that agents used in the polymerization such as surfactants are left remaining on the surface of the toner and adversely affect the property for electrostatic charge of the toner and that a very great amount of the initial investment in the apparatus is required. The toner prepared in accordance with the suspension polymerization process has a further problem in that, when the toner left remaining on the photosensitive member after the transcription is cleaned with an elastic blade, incomplete cleaning tends to take place since the shape of the particles is almost perfectly spherical, Examples of the toner formed by rounding by the heat treatment include a toner described in Patent Reference 3 [Japanese Patent Application Laid-Open No. Heisei 11 (1999)-295929]. However, the agents added from the outside tend to be separated since the surface of the toner particles is smooth and wax is present on the surface in a significant amount. It occasionally takes place that the wax component works as the binder, and the agents added from the outside contaminate the development roller and the charge roller.

[Patent Reference 1] Japanese Patent Application Laid-Open No. Heisei 11 (1999)-133669

[Patent Reference 2] Japanese Patent Application Laid-Open No. 2002-107999

[Patent Reference 3] Japanese Patent Application Laid-Open No. Heisei 11 (1999)-295929

DISCLOSURE OF THE INVENTION

The present invention has an object of providing a toner for developing electrostatic images which can form printed images of a high quality with an excellent transfer rate, suppressed contamination of the charge roller, minimal background and small consumption of the toner and a process for producing the toner.

As the result of intensive studies by the present inventors to achieve the above object, it was found that the contamination of the charge roller and background could be effectively suppressed by adding inorganic fine particles having a roundness of 1.00 to 1.30, an average of the diameter of primary particles of 0.05 to 0.45 μm and a ratio of a standard deviation to the average of the diameter of primary particles of 0.25 or smaller to toner particles as an external additive, and it was effective that the above inorganic fine particles were added to toner particles prepared by rounding by a heat treatment and that the inorganic fine particles were added alone or in combination with a small amount of hydrophobic silica. The present invention has been completed based on the knowledge.

The present invention provides:

(1) A toner for developing electrostatic images which is obtained by melt mixing at least a binder resin and a coloring agent, forming a powder material by pulverizing an obtained mixture after cooling and removing rough particles and fine particles from a formed powder material by classification, wherein inorganic fine particles having a roundness of 1.00 to 1.30, an average of diameter of primary particles of 0.05 to 0.45 μm and a ratio of a standard deviation to the average of diameter of primary particles of 0.25 or smaller are added as an external additive;

(2) The toner for developing electrostatic images described in (1), wherein the inorganic fine particles are particles of barium titanate;

(3) The toner for developing electrostatic images described in any one of (1) and (2), wherein the powder material is made round by a heat treatment under a floating condition;

(4) The toner for developing electrostatic images described in any one of (1) to (3), which is a non-magnetic single component toner;

(5) A process for producing a toner for developing electrostatic images which comprises melt mixing at least a binder resin and a coloring agent, forming a powder material by pulverizing an obtained mixture after cooling, rounding the powder material by a heat treatment and adding to the rounded powder material inorganic fine particles having a roundness of 1.00 to 1.30, an average of diameter of primary particles of 0.05 to 0.45 μm and a ratio of a standard deviation to the average of diameter of primary particles of 0.25 or smaller; and (6) The process for producing a toner for developing electrostatic images described in (5), wherein, simultaneously with the addition of the inorganic fine particles having a roundness of 1.00 to 1.30, an average of diameter of primary particles of 0.05 to 0.45 μm and a ratio of a standard deviation to the average of diameter of primary particles of 0.25 or smaller, hydrophobic silica is added in an amount such that a ratio of an amount by weight of the hydrophobic silica to an amount by weight of the inorganic fine particles is 0.8 or smaller.

THE MOST PREFERRED EMBODIMENT TO CARRY OUT THE INVENTION

The toner for developing electrostatic images of the present invention is a toner for developing electrostatic images which is obtained by melt mixing at least a binder resin and a coloring agent, forming a powder material by pulverizing the obtained mixture after cooling and removing rough particles and fine particles from the formed powder material by classification, wherein inorganic fine particles having a roundness of 1.00 to 1.30, an average of the diameter of primary particles of 0.05 to 0.45 μm and a ratio of the standard deviation to the average of the diameter of primary particles of 0.25 or smaller are added as an external additive.

In the present invention, it is preferable that the inorganic fine particles having a roundness of 1.00 to 1.30, an average of the diameter of primary particles of 0.05 to 0.45 μm and a ratio of the standard deviation to the average of the diameter of primary particles of 0.25 or smaller are particles of barium titanate. As the process for producing the particles of barium titanate, the solid reaction process in which the solid state reaction between barium carbonate and titanium oxide is conducted; the oxalic acid salt process in which barium titanyl oxalate obtained by the reaction of barium chloride, titanium tetrachloride and oxalic acid is thermally decomposed, the citric acid salt process in which barium titanium citrate obtained by the reaction of an aqueous solution of barium citrate and an aqueous solution of titanium citrate is thermally decomposed, the hydrothermal process in which barium hydroxide and metatitanic acid are brought into reaction under a high temperature and a high pressure, the sol-gel process in which a gel of barium hydroxide and a sol of titanium are mixed, dried, incinerated and pulverized, and the alkoxide process in which an alkoxide of titanium is used as the raw material, have been known. Barium titanate produced in accordance with the alkoxide process in which an alkoxide of titanium is used as the raw material is preferable among the above processes.

Barium titanate produced in accordance with the alkoxide process has a very narrow distribution of the particle size and a shape close to the sphere. It is preferable that the barium titanate used in the present invention has a ratio of the standard deviation to the average of the diameter of primary particles of 0.25 or smaller and more preferably 0.20 or smaller. When the ratio of the standard deviation to the average of the diameter of primary particles exceeds 0.25, the distribution of the particle size is broad, and there is the possibility that barium titanate is buried into the toner particles or separated from the surface of the toner particles or that a portion of barium titanate is buried and another portion is separated. Since particles of barium titanate used in the present invention have a shape close to the sphere with a roundness of 1.00 to 1.30, aggregation of the particles is suppressed, and the particles tend to be uniformly dispersed and attached as primary particles when the particles are mixed with the toner particles as the external additive. When the roundness exceeds 1.30, the particles have various shapes, and the uniform distribution on the surface of the toner becomes difficult due to aggregation of the particles. Since the secondary aggregates on the surface of the toner are easily separated, there is the possibility that members of the printer are contaminated.

The inorganic fine particles used in the present invention have small diameters, spherical shapes and very narrow distribution of the size. Therefore, separation of the inorganic fine particles from the toner particles during the process of forming images is suppressed, and contamination of members of the printer is suppressed. Since barium titanate has a small volume resistivity, the possibility of adversely affecting the quality of images is small even when particles of barium titanate are separated from the toner particles and contaminate members of the printer. Formation of excessive electrostatic charge on the toner under an environment of a low humidity is prevented, and the decrease in the image density and the background are suppressed.

As barium titanate produced in accordance with the alkoxide process which is used in the present invention, any of barium titanate produced in accordance with the half alkoxide process and barium titanate produced in accordance with the complete alkoxide process can be used. In the half alkoxide process, an aqueous solution of barium hydroxide and a titanium alkoxide are mixed and brought into reaction with each other by heating under the refluxing condition, and the formed precipitates are crystallized to obtain the product. In the complete alkoxide process, a barium alkoxide and a titanium alkoxide are used as the raw materials.

In the present invention, the inorganic fine particles used as the outside additive have an average of the diameter of primary particles of 0.05 to 0.45 μm and preferably 0.1 to 0.4 μm. When the average of the diameter of primary particles of the inorganic fine particles is smaller than 0.05 μm, there is the possibility that the effect as the spacer between the toner particles is not exhibited, or that the inorganic fine particles are buried into the surface of the toner, and the stained portions are formed. When the average of the diameter of primary particles of the inorganic fine particles exceeds 0.45 μm, there is the possibility that the inorganic fine particles are easily separated from the surface of the toner particles.

In the toner for developing electrostatic images of the present invention, it is preferable that the particles forming the toner have a shape rounded by the heat treatment under the floating condition. When the toner particles is made round by the heat treatment, the property for transcription of the toner for developing electrostatic images can be improved, and formation of the uniform electrostatic charge on the toner particles is facilitated. On the other hand, a release agent contained in the toner particles exude out of the surface of the particles, and separation of the fine particles of the outside additive tends to take place. In general, among particles of the external additive to the toner, particles having a greater size tend to be separated from the surface of the toner more easily, and particles having a smaller size tend to be buried into the surface of the toner particles. No conventional particles added to the toner externally have the property overcoming both of the problems that particles are separated from the surface of the toner and that the particles are buried into the surface of the toner since conventional particles added externally have a broad distribution of the particle size. The inorganic fine particles used in the present invention has a very narrow distribution of the particle size. Therefore, even when the toner particles are particles rounded by the heat treatment, separation of the particles is suppressed, and contamination of members of the printer can be prevented. It is preferable that the toner particles treated by heating under the floating condition has an average circularity of 0.930 to 0.980 and more preferably 0.945 to 0.970. When the average circularity of the toner particles is smaller than 0.930, there is the possibility that the property for transcription of the toner for developing electrostatic images becomes poor. When the average circularity of the toner particles exceeds 0.980, there is the possibility that wiping of the toner particles attached to the photosensitive member with a cleaning blade becomes insufficient.

The toner for developing electrostatic images of the present invention can be advantageously used as the non-magnetic single component toner. For development with the non-magnetic single component toner, it is considered to be important that a thin layer of the toner is formed on the development roller. When the toner particles have a spherical shape, static electricity is charged uniformly, and a uniform layer can be easily formed on the development roller. Since the linear pressure to the development roller with the regulator blade is great, the load to the toner is great during formation of images for a long period of time, and the external additive tends to be separated from the toner particles when the external additive forms aggregates. In the inorganic fine particles used in the present invention, the aggregation of the particles is suppressed due to the very narrow distribution of the particle size and the shape close to the spherical shape, and the inorganic fine particles are present uniformly on the surface of the toner particles approximately in the condition of primary particles. Therefore, the separation from the surface of the toner particles is suppressed, and the excellent quality of the images can be maintained even during formation of images for a long period of time.

The process for producing a toner for developing electrostatic images of the present invention comprises melt mixing at least a binder resin and a coloring agent, forming a powder material by pulverizing the obtained mixture after cooling, rounding the powder material by a heat treatment and adding to the rounded powder material inorganic fine particles having a roundness of 1.00 to 1.30, an average of the diameter of primary particles of 0.05 to 0.45 μm and a ratio of the standard deviation to the average of the diameter of primary particles of 0.25 or smaller. In the process of the present invention, examples of the component other than the coloring agent which is melt mixed in combination with the binder resin include charge control agents and mold releases.

Examples of the binder resin used in the present invention include polyester-based resins, polyamide-based resins, polyurethane-based resins, acrylic resins, polyolefin-based resins such as polyethylene and polypropylene, cyclic olefin copolymers such as ethylene-norbornene copolymers, diene-based resins, silicone-based resins, ketone resins, maleic acid resins, coumarone resins, phenol resins, epoxy resins, terpene resins, petroleum resins, styrene-based resins such as polystyrene, styrene-butadiene copolymers, styrene-maleic acid copolymers and styrene-(meth)acrylic acid ester copolymers, polybutyl(meth)acrylate and polyvinyl butyral. Among these binder resins, polyester-based resins and styrene-(meth) acrylic acid ester copolymers are preferable. Examples of the polyester-based resin include polyesters obtained by polycondensation of aromatic dicarboxylic acids and bisphenol A and modified with an alkylene ether. Examples of the styrene-(meth)acrylic acid ester copolymer include styrene-butyl acrylate-butyl methacrylate copolymer. It is preferable that the binder resin used in the present invention has a glass transition temperature of 50 to 75° C. and more preferably 55 to 70° C. When the glass transition temperature is lower than 50° C., there is the possibility that the storage property of the toner for developing electrostatic image becomes poor. When the glass transition temperature exceeds 75° C., there is the possibility that the property of the toner for developing electrostatic image for fixing at low temperatures is insufficient.

The coloring agent used in the present invention is not particularly limited, and any of various inorganic and organic pigments and dyes can be used. Examples of the black pigment include carbon black, copper oxide, triiron tetraoxide, manganese dioxide and aniline black. Examples of the yellow pigment include permanent yellow, chrome yellow, quinoline yellow, benzidine yellow, yellow iron oxide, C. I. pigment yellow 97, C. I. yellow pigment yellow 17, C. I. pigment yellow 180 and C. I. solvent yellow 162. Examples of the red pigment include red iron oxide, lake red, rhodamine 6B, quinacridone, carmine 6B, C. I. pigment red 48:1, C. I. pigment red 122, C. I. pigment red 57:1 and C. I. pigment red 184. Examples of the blue pigment include Prussian blue, cobalt blue, phthalocyanine blue, aniline blue, C. I. pigment blue 15:1 and C. I. pigment blue 15:3. In the process of the present invention, it is preferable that the content of the coloring agent in the toner for developing electrostatic images is 1 to 20% by weight and more preferably 2 to 8% by weight. When the content of the coloring agent is smaller than 1% by weight, there is the possibility that the necessary density of images is not obtained. When the content of the coloring agent exceeds 20% by weight, there is the possibility that the property of the toner for fixing decreases.

In the process of the present invention, a charge control agent can be mixed into the binder resin and melt mixed together. By using the charge control agent, the electrostatic property of the toner for developing electrostatic images can be stabilized, and background can be prevented. Examples of the charge control agent which controls the toner at the negative charge include monoazo metal compounds, acetylacetone metal compounds, aromatic hydroxycarboxylic acids, salicylic acid-based compounds containing a metal, boron complex compounds and calixarene. Examples of the charge control agent which controls the toner at the positive charge include salts of tributylbenzyl-ammonium-1-hydroxy-4-naphthosulfonic acid, nigrosin, guanidine compounds, triphenylmethane dyes and quaternary ammonium salts.

In the process of the present invention, a release agent can be mixed into the binder resin and melt mixed together. By using the release agent, attachment of the toner particles to the fuser roll can be prevented. Examples of the release agent used in the process of the present invention include plant waxes such as carnauba wax and rice wax, petroleum waxes such as paraffin wax and microcrystalline wax, mineral waxes such as montan wax and chandelier wax, synthetic waxes such as carbowax, polyethylene wax, polypropylene wax and chlorinated naphthalene wax, higher fatty acids such as stearic acid, arachic acid and behenic acid, higher alcohols such as ceryl alcohol and melissyl alcohol, amide-based waxes such as stearamide and behenamide, esters of polyhydric alcohols such as glycerol monostearate and glycerol distearate, and silicone varnish.

In the process of the present invention, the process for melt mixing the binder resin, the coloring agent, the charge control agent and the release agent is not particularly limited. For example, these raw materials can be mixed in advance using a mixer of the ribbon type, a mixer of the double cone type, a high speed mixer or a screw mixer of the cone type and then melt mixed using a Banbury mixer, a twin screw mixer extruder or a three roll mixer. The process for pulverizing the product of melt mixing after being cooled to form a powder material is not particularly limited. For example, the product of melt mixing can be preliminarily pulverized using a pulverizer of the impact type such as an impact crusher and a hammer crusher and then finely pulverized using a pulverizer of the hitting type such as a rod mill and a ball mill or a pulverizer of the jet type utilizing the compressed air such as a counter jet mill.

In the process of the present invention, the powder material obtained by pulverization of the product of melt mixing or the powder material having a distribution of the particle size narrowed by removing rough particles and fine particles by classification is rounded to a spherical shape by a heat treatment under the floating condition. When the toner particles have shapes closer to the sphere, distribution of the charge on the toner is made uniform, and excellent images can be obtained with suppressed background and excellent reproducibility of narrow lines. The overall quality is improved in that the transfer rate is improved, formation of voids in characters is prevented, and the life of the photosensitive member is increased. Productivity of the step of rounding can be improved by adding fine particles such as fine particles of silica externally in advance as the free-flow agent in the heat treatment of the powder material. It is preferable that silica added externally is hydrophobic silica having the surface treated for providing the hydrophobic property, for example, with a silane coupling agent. It is preferable that the amount of silica added externally is 0.1 to 6 parts by weight and more preferably 0.3 to 4 parts by weight per 100 parts by weight of the powder material. The silica added externally before the treatment for rounding is buried at the inside of the binder resin during the treatment of rounding and does not sufficiently exhibit the ordinary function of the outside additive such as improvements in the free-flow and the charging property after the powder material is rounded. Therefore, it is preferable that an external additive is added further in a step after the rounding in accordance with the necessity.

In the process of the present invention, as the means for the heat treatment of the powder material, for example, an apparatus for rounding with the heated air in which the powder material is rounded by melting the surface while the powder material is suspended in a tank of the fluidized bed or in a stream of the heated air, can be used. It is preferable that the average circularity of the mother particles of the toner is adjusted by the heat treatment in the range of 0.930 to 0.980 and more preferably in the range of 0.945 to 0.970 in which the excellent property for transcription is exhibited. When the average circularity is smaller than 0.930, the force of attachment of the toner particles to the development roller or the photosensitive member increases, and there is the possibility that the transfer rate decreases and the quality of the obtained images decreases. When the average circularity exceeds 0.980, there is the possibility that, when the toner left remaining on the photosensitive member after the transcription is cleaned with a blade, the toner passes through the blade and is not completely removed.

In the process of the present invention, after the mixture obtained by pulverization of the product of melt mixing the binder resin, the coloring agent and the other components is rounded by the heat treatment, inorganic fine particles having a roundness of 1.00 to 1.30, an average of the diameter of primary particles of 0.05 to 0.45 μm and a ratio of the standard deviation to the average of the diameter of primary particles of 0.25 or smaller are added to the rounded powder material. Heretofore, toners rounded by the heat treatment have a problem in that wax components tend to be left remaining on the surface of the particles in a degree greater than that of conventional toners obtained by mixing and pulverization, and external additives are separated. The problem of separation can be overcome by using the inorganic fine particles having a sharp distribution of the particle size. Since the content of extremely fine particles is small, the particles are not buried into the toner particles. Background can be suppressed and the consumption of the toner can be decreased by adding the inorganic fine particles having a roundness of 1.00 to 1.30, an average of the diameter of primary particles of 0.05 to 0.45 μm and a ratio of the standard deviation to the average of the diameter of primary particles of 0.25 or smaller.

In the present invention, it is preferable that the inorganic fine particles are fine particles of barium titanate obtained in accordance with the alkoxide process. Since the fine particles of barium titanate obtained in accordance with the alkoxide process have a very narrow distribution of the particle size, separation of the particles from the toner particles is suppressed during formation of images for a long period of time, and background can be prevented for a long period of time.

Excellent reproducibility of dots and narrow lines is exhibited, and the high quality of images can be maintained with suppressed consumption of the toner. Since the particles of barium titanate obtained in accordance with the alkoxide process have shapes close to the sphere, aggregation of particles is suppressed, and the particles tend to be attached uniformly as the primary particles when the particles are mixed with the toner particles as the external additive. It is considered that the tendency of the particles to be present as the primary particles contributes to the suppressed separation from the toner particles. As another characteristic of the particles of barium titanate obtained in accordance with the alkoxide process, damages on images are suppressed even when the particles are separated from the toner particles and contaminate members of the printer since the volume resistivity is smaller than that of hydrophobic silica. Moreover, formation of excessive electrostatic charge on the toner under an environment of a low humidity is prevented, and the high quality of images can be maintained. In the process of the present invention, it is preferable that particles of barium titanate are particles having the surface treated with a silane coupling agent or the like agent.

In the process of the present invention, other external additives such as hydrophobic silica, titanium oxide and alumina may be used as the outside additive in combination with the above components. Free-flow property of the toner for developing electrostatic images can be improved by using the other outside additive in combination. However, when the inorganic fine particles having a roundness of 1.00 to 1.30, an average of the diameter of primary particles of 0.05 to 0.45 μm and a ratio of the standard deviation to the average of the diameter of primary particles of 0.25 or smaller are added to the mother particles of the toner as the external additive, it is preferable that no other external additives are added in combination simultaneously in a step. When an outside additive such as hydrophobic silica is added simultaneously in a step with the inorganic fine particles having a roundness of 1.00 to 1.30, an average of the diameter of primary particles of 0.05 to 0.45 μm and a ratio of a standard deviation to the average of the diameter of primary particles of 0.25 or smaller, it is preferable that the ratio of the amount by weight of the other outside additive to the amount by weight of the inorganic fine particles is 0.8 or smaller. When the ratio of the amount by weight of the other outside additive added simultaneously to the amount by weight of the inorganic fine particles exceeds 0.8, there is the possibility that the other additive and the inorganic fine particles form aggregates, and separation of the particles from the toner particles is made easier to cause contamination of members of the printer.

In the process of the present invention, the process for mixing the toner particles and the outside additive is not particularly limited. Mixers exhibiting a great shearing force during the mixing is preferable since pulverization of particles of the outside additive can take place more easily. Examples of the mixer include a mixer of the high speed stirring type [manufactured by MITSUI KOZAN Co. Ltd., HENSHEL MIXER (a registered trade name), Q-TYPE MIXER] and a mixing apparatus providing mechanical impact force [manufactured by HOSOKAWA MICRON Co. Ltd., NOBILTA (a registered trade name)].

EXAMPLES

The present invention will be described more specifically with reference to examples in the following. However, the present invention is not limited to the examples.

(1) Average and Standard Deviation of the Diameter of Primary Particles of Inorganic Fine Particles Images of external additive were observed at a magnification of 20,000 using a scanning electron microscope (SEM) [manufactured by NIPPON DENSHI DATUM Co. Ltd., JSM-5200]. The diameter of 100 particles were obtained using a software for image analysis, and the average and the standard deviation were calculated from the obtained data.

(2) Roundness of Inorganic Fine Particles

Pictures of particles of an outside additive were taken at a magnification of 20,000 using a scanning electron microscope (SEM) [manufactured by NIPPON DENSHI DATUM Co. Ltd., JSM-5200]. The length of the circumference and the area of 100 particles were obtained using a soft ware for image analysis, and the roundness was calculated in accordance with the following equation:

$$\text{roundness}=(\text{length of circumference})^2/\{4\pi\times(\text{area})\}$$

(3) Softening Temperature of Binder Resin

A capillary rheometer [manufactured by SHIMADZU SEISAKUSHO Co. Ltd., CFT-500C] described in Japanese Industrial Standard K 7199 was used. The inner diameter of the cylinder was 11.329 mm, and the inner diameter and the length of the capillary die were 1 mm and 1 mm, respectively. The inside of the cylinder was packed with 1.0 g of a resin, and a load of 98 N was applied to the piston. The temperature was raised from 50° C. at a rate of 5° C./min, and the temperature at which one half of the resin in the cylinder had been extruded was used as the flow tester $T_{1/2}$.

(4) Average Circularity of Particles

Using a flow type analyzer of particle images [manufactured by SYSMEX Co. Ltd., FPIA-2100], with respect to particles having a diameter corresponding to the diameter of a circle of 3 μm or greater, the average circularity of particles was obtained in accordance with the following equation:

average circularity=(length of circumference of a circle having the same area as the projected area of a particle)/(length of circumference of the projected image of the particle)

(5) Background

In accordance with the Japanese Industrial Standard P 8152, the reflectance of a virgin paper and the reflectance of a blank portion of images were obtained using a colorimeter [manufactured by MINOLTA Co. Ltd., CR-200], and the background was evaluated from the difference in the reflectances.

good: smaller than 1.0% fair: 1.0% or greater and smaller than 2.0% (no problem for practical use)

poor: 2.0% or greater (6) Consumption of Toner

Printing was made on 6,000 sheets of paper of the A4 size with a print coverage of 5%. The amount of the used toner was calculated from the difference in the weight of the cartridge developer unit before and after the printing, and the obtained amount was divided by the number of the printed sheet of paper.

good: less than 20 mg/sheet fair: 20 mg/sheet or more and less than 25 mg/sheet (no problem for practical use)

poor: 25 mg/sheet or more (7) Contamination of Charge Roller excellent: not contaminated at all good: slightly contaminated fair: somewhat contaminated, but no problem for practical use poor: contaminated, and ghost formed on images due to poor electrostatic charge Synthesis Example 1

Preparation of Barium Titanate in Accordance with the Complete Alkoxide Process

Under the atmosphere of nitrogen, 75.3 g (0.297 moles) of barium isopropoxide [manufactured by WAKO JUN-YAKU KOGYO Co. Ltd.] and 92.7 g (0.326 moles) of titanium tetraisopropoxide [manufactured by WAKO JUN-YAKU KOGYO Co. Ltd.] were dissolved into 350 ml of isopropyl alcohol, and the resultant solution was heated under the refluxing condition for 2 hours. While the heating of the solution under the refluxing condition was continued, 65 ml of distilled water was added dropwise over 1 hour so that the isopropoxides were hydrolyzed. The obtained mixture was cooled at the room temperature, and the concentration of the slurry was adjusted by adding water at 0.5 moles/liter as calculated as the concentration of $BaTiO_3$. The resultant slurry was heated to the temperature of boiling over 1 hour and further heated under the refluxing condition for 3 hours. The obtained mixture was cooled at the room temperature, washed with water by repeated decantation, filtered using a Buchner funnel, washed with water, dried at 105° C. and pulverized, and 63.7 g of a fine powder material of barium titanate was obtained. The yield was 92%. The obtained barium titanate was barium titanate having the spherical form of the cubic crystal system, had an average of the diameter of primary particles of 0.15 μm, a standard deviation of the diameter of primary particles of 0.027 μm, a ratio of the standard deviation to the average of the diameter of primary particles of 0.18 and a roundness of 1.27 as obtained by the observation by an electron microscope and a BET specific surface area of 11.7 $m^2/g$ as measured by using nitrogen. Barium titanate obtained above will be called Barium titanate of the alkoxide process A.

Synthesis Example 2

Preparation of Barium Titanate in Accordance with the Half Alkoxide Process

Into 117 ml of distilled water, 15.8 g (0.05 moles) of barium hydroxide octahydrate was added and dissolved by heating at 80° C. To the resultant solution, a solution prepared by dissolving 16.8 g (0.0495 moles) of titanium tetra-n-butoxide into 37.7 ml of toluene was added under the atmosphere of nitrogen. The obtained solution was heated under the refluxing condition for 1 hour and, then, toluene and n-butyl alcohol were removed by distillation by further raising the temperature. Distilled water was added to the obtained slurry so that the amount of water in the slurry was adjusted at 100 ml and, then, 100 ml of acetone was added. The resultant slurry was cooled at 10° C., stirred for 2 hours, filtered using a Buchner funnel. The obtained solid material was dried at 60° C. for 12 hours and incinerated at 850° C. for 1 hour, and 10.4 g of a fine powder material of barium titanate was obtained. The yield was 90%. The obtained barium titanate was barium titanate having the spherical form of the cubic crystal system, had an average of the diameter of primary particles of 0.32 μm, a standard deviation of the diameter of primary particles of 0.049 μm, a ratio of the standard deviation to the average of the diameter of primary particles of 0.15 and a roundness of 1.17 as obtained by the observation by an electron microscope and a BET specific surface area of 4.5 $m^2$ as measured by using nitrogen. Barium titanate obtained above will be called Barium titanate of the alkoxide process B.

Example 1

A polyester resin [the number-average molecular weight: 3,400, the weight-average molecular weight: 133,800, the acid value: 5.0 mg KOH/g, the glass transition temperature: 61° C., the flow tester $T_{1/2}$: 130° C.] in an amount of 92.0 parts by weight, 5.0 parts by weight of carbon black [manufactured by CABOT Corporation: BLACK PEARLS L], 1.0 part by weight of a charge control agent [manufactured by ORIENT KAGAKU KOGYO Co. Ltd., E-304] and 2.0 parts by weight of wax [manufactured by SANYO KASEI KOGYO Co. Ltd., UMEX 110TS] were preliminarily mixed by a mixer with high speed stirring [manufactured by MITSUI KOZAN Co. Ltd., HENSHEL MIXER (a registered trade name)], then melt mixed by a twin screw extruder [manufactured by IKEGAI Co. Ltd., PCM-30] and pulverized by a pulverizer of the jet type [manufactured by HOSOKAWA MICRON Co. Ltd., COUNTER JET MILL] so that the volume-average diameter of the particles was 7.5 μm.

To 100 parts by weight of the obtained powder material, 0.3 parts by weight of hydrophobic silica [manufactured by CABOT Corporation, TS-530, hydrophobic treatment with hexamethyldisilazane, the average of the diameter of primary particles: 7 nm, the BET specific surface area: 225 $m^2/g$] and 0.5 parts by weight of hydrophobic silica [manufactured by NIPPON AEROSIL Co. Ltd., RX-50, hydrophobic treatment with hexamethyldisilazane, the average of the diameter of primary particles: 40 nm, the BET specific surface area: 35 $m^2/g$] were added and mixed by HENSHEL MIXER [manufactured by MITSUI KOZAN Co. Ltd.]. The obtained mixture was treated by heating with the heated air at a temperature of 280° C. using an apparatus for rounding with the heated air [manufactured by NIPPON PNEUMATIC KOGYO Co. Ltd., SFS-3], and rounded particles having an average circularity of 0.958 and a volume-average diameter of particles of 7.9 μm were obtained.

To 100 parts by weight of the rounded particles obtained above, 0.5 parts by weight of hydrophobic silica [manufactured by CABOT Corporation, TS-530, hydrophobic treatment with hexamethyldisilazane, the average of the diameter of primary particles: 7 nm, the BET specific surface area: 225 $m^2/g$] and 0.75 parts by weight of Barium titanate of the alkoxide process A prepared in Synthesis Example 1 were added. The obtained mixture was mixed by HENSHEL MIXER [manufactured by MITSUI KOZAN Co. Ltd.] at a circumferential speed of 40 m/s and passed through an ultrasonic vibration sieve [manufactured by DALTON Co. Ltd.] equipped with a 200 mesh screen, and a toner for developing electrostatic images was obtained.

A black toner cartridge of a laser printer of the non-magnetic single component development type was packed with the toner for developing electrostatic images obtained above, and printing was made on 6,000 sheets of paper of the A4 size with a printing pattern having a fraction of the printed portion of 5%. The reflectance of the virgin paper was 87.40%, and the reflectance of a blank portion of images on the 6,000th sheet was 86.87%. The property for preventing formation of stained portions was good. The consumption of the toner was 16.1 mg/sheet. Slight contamination was found on the charge roller.

Example 2

A toner for developing electrostatic images was prepared and evaluated in accordance with the same procedures as those conducted in Example 1 except that 0.75 parts by weight of Barium titanate of the alkoxide process A prepared in Synthesis Example 1 was added to 100 parts by weight of the rounded particles used in Example 1.

The reflectance of the virgin paper was 88.05%, and the reflectance of a blank portion of images on the 6,000th sheet was 87.45%. The property for preventing formation of stained portions was good. The consumption of the toner was 15.6 mg/sheet. No contamination was found on the charge roller.

Example 3

A toner for developing electrostatic images was prepared and evaluated in accordance with the same procedures as those conducted in Example 1 except that 0.75 parts by weight of Barium titanate of the alkoxide process B prepared in Synthesis Example 2 was added to 100 parts by weight of the rounded particles used in Example 1.

The reflectance of the virgin paper was 87.93%, and the reflectance of a blank portion of images on the 6,000th sheet was 87.14%. The property for preventing formation of stained portions was good. The consumption of the toner was 17.2 mg/sheet. Some contamination was found on the charge roller, but there was no problem for the practical use.

Example 4

A toner for developing electrostatic images was prepared and evaluated in accordance with the same procedures as those conducted in Example 1 except that 0.5 parts by weight of hydrophobic silica [manufactured by CABOT Corporation, TS-530, hydrophobic treatment with hexamethyldisilazane, the average of the diameter of primary particles: 7 nm, the BET specific surface area: 225 $m^2/g$], 0.5 parts by weight of hydrophobic silica [manufactured by NIPPON AEROSIL Co. Ltd., RX-50, hydrophobic treatment with hexamethyldisilazane, the average of the diameter of primary particles: 40 nm, the BET specific surface area: 35 $m^2/g$] and 0.75 parts by weight of Barium titanate of the alkoxide process A prepared in Synthesis Example 1 were added to 100 parts by weight of the rounded particles used in Example 1.

The reflectance of the virgin paper was 87.88%, and the reflectance of a blank portion of images on the 6,000th sheet was 86.80%. The property for preventing formation of stained portions was fair. The consumption of the toner was 18.5 mg/sheet. Some contamination was found on the charge roller, but there was no problem for the practical use.

Comparative Example 1

A toner for developing electrostatic images was prepared and evaluated in accordance with the same procedures as those conducted in Example 1 except that 0.5 parts by weight of hydrophobic silica [manufactured by CABOT Corporation, TS-530, hydrophobic treatment with hexamethyldisilazane, the average of the diameter of primary particles: 7 nm, the BET specific surface area: 225 $m^2/g$] and 0.75 parts by weight of titanium oxide [the average of the diameter of primary particles: 0.24 μm, the standard deviation of the diameter of primary particles: 0.065 μm, the ratio of the standard deviation to the average of the diameter of primary particles: 0.27, the roundness: 1.24, the BET specific surface area: 6.9 $m^2/g$] were added to 100 parts by weight of the rounded particles used in Example 1.

The reflectance of the virgin paper was 87.75%, and the reflectance of a blank portion of images on the 6,000th sheet was 86.99%. The property for preventing formation of stained portions was good. The consumption of the toner was 20.6 mg/sheet. Contamination was found on the charge roller, and ghost appeared on the images due to poor electrostatic charge.

Comparative Example 2

A toner for developing electrostatic images was prepared and evaluated in accordance with the same procedures as those conducted in Example 1 except that 0.5 parts by weight of hydrophobic silica [manufactured by CABOT Corporation, TS-530, hydrophobic treatment with hexamethyldisilazane, the average of the diameter of primary particles: 7 nm, the BET specific surface area: 225 $m^2/g$] was added to 100 parts by weight of the rounded particles used in Example 1.

The reflectance of the virgin paper was 87.69%, and the reflectance of a blank portion of images on the 6,000th sheet was 85.28%. The property for preventing formation of stained portions was poor. The consumption of the toner was 28.5 mg/sheet. Slight contamination was found on the charge roller.

The result of Examples 1 to 4 and Comparative Examples 1 and 2 are shown in Table 1.

TABLE 1

| | Before rounding | | After rounding | |
|---|---|---|---|---|
| | type | amount (part by weight) | type | amount (part by weight) |
| Example 1 | hydrophobic silica (7 nm) | 0.3 | hydrophobic silica (7 nm) | 0.5 |
| | hydrophobic silica (40 nm) | 0.5 | $TiBaO_3$ (0.15 μm) | 0.75 |
| Example 2 | hydrophobic silica (7 nm) | 0.3 | $TiBaO_3$ (0.15 μm) | 0.75 |
| | hydrophobic silica (40 nm) | 0.5 | | |
| Example 3 | hydrophobic silica (7 nm) | 0.3 | $TiBaO_3$ (0.32 μm) | 0.75 |
| | hydrophobic silica (40 nm) | 0.5 | | |
| Example 4 | hydrophobic silica (7 nm) | 0.3 | hydrophobic silica (7 nm) | 0.5 |
| | hydrophobic silica (40 nm) | 0.5 | hydrophobic silica (40 nm) | 0.5 |
| | | | $TiBaO_3$ (0.15 μm) | 0.75 |
| Comparative Example 1 | hydrophobic silica (7 nm) | 0.3 | hydrophobic silica (7 nm) | 0.5 |
| | hydrophobic silica (40 nm) | 0.5 | titanium oxide (0.24 μm) | 0.75 |
| Comparative Example 2 | hydrophobic silica (7 nm) | 0.3 | hydrophobic silica (7 nm) | 0.5 |
| | hydrophobic silica (40 nm) | 0.5 | | |

Notes
The value in the parenthesis shows the average of the diameter of primary particles.
$TiBaO_3$: Barium titanate of the alkoxide process

TABLE 2

| | Background | | Consumption of toner | | Contamination of roller for electrostatic |
|---|---|---|---|---|---|
| | (%) | | (mg/sheet) | | charge |
| Example 1 | 0.53 | good | 16.1 | good | good |
| Example 2 | 0.60 | good | 15.6 | good | excellent |

TABLE 2-continued

| | Background | | Consumption of toner | | Contamination of roller for electrostatic |
|---|---|---|---|---|---|
| | (%) | | (mg/sheet) | | charge |
| Example 3 | 0.79 | good | 17.2 | good | fair |
| Example 4 | 1.08 | fair | 18.5 | good | fair |
| Comparative Example 1 | 0.76 | good | 20.6 | fair | poor |
| Comparative Example 2 | 2.41 | poor | 28.5 | poor | good |

As shown by the results in Table 2, in the cases of the toners for developing electrostatic images of Examples 1 and 2 in which barium titanate of the alkoxide process having an average of the diameter of primary particles of 0.15 μm was added after the classification, the background and the consumption of the toner were suppressed, and no or slight contamination of the charge roller was found. In the case of the toner for developing electrostatic images of Example 3 in which barium titanate of the alkoxide process having an average of the diameter of primary particles of 0.32 μm was added, the consumption of the toner slightly increased, and slight contamination of the charge roller was found although there was no problem on the practical application. In the case of the toner for developing electrostatic images of Example 4 in which barium titanate of the alkoxide process having an average of the diameter of primary particles of 0.15 μm was added and hydrophobic silica in an amount twice the amount of barium titanate was simultaneously added, the consumption of the toner increased, and slight contamination of the charge roller was found although there was no problem on the practical application. In the case of the toner for developing electrostatic images of Comparative Example 1 in which hydrophobic silica and titanium oxide were added, the consumption of the toner considerably increased, and marked contamination of the charge roller was found. In the toner for developing electrostatic images of Comparative Example 2 in which hydrophobic silica alone was added after the classification, background increased markedly, and the consumption of the toner increased markedly.

INDUSTRIAL APPLICABILITY

Since the inorganic fine particles having a roundness of 1.00 to 1.30, an average of the diameter of primary particles of 0.05 to 0.45 μm and a ratio of the standard deviation to the average of the diameter of primary particles of 0.25 or smaller are added as the external additive in the toner for developing electrostatic images of the present invention, separation of the outside additive from the toner particles is suppressed during the formation of images for a long period of time, the fluidity is excellent, the background is suppressed, printed images of a high quality can be formed with a small consumption of the toner, and contamination of members of the printer such as the charge roller is almost absent. In accordance with the process for producing a toner for developing electrostatic images of the present invention, since the inorganic fine particles having a roundness of 1.00 to 1.30, an average of the diameter of primary particles of 0.05 to 0.45 μm and a ratio of the standard deviation to the average of the diameter of primary particles of 0.25 or smaller are added to the mother particles of the toner rounded by the heat treatment, separation of the outside additive from the toner particles rounded by the heat treatment, which is the drawback of the conventional toner particles rounded by the heat treatment, can be prevented, the inorganic fine particles are not buried into the toner particles, aggregates of the inorganic fine particles with particles of other external additives are not formed, and the toner for developing electrostatic images of the N-type exhibiting high performances can be produced efficiently.

The invention claimed is:

1. A toner for developing electrostatic images which is obtained by melt mixing a binder resin and a coloring agent to obtain a mixture, pulverizing the mixture after cooling to obtain a powder material, treating the powder material by heating under a floating condition to obtain rounded particles and removing rough particles and fine particles from the rounded particles by classification to obtain mother particles of the toner having an average circularity of 0.930 to 0.980, wherein inorganic fine particles having a roundness of 1.00 to 1.30, an average of diameter of primary particles of 0.05 to 0.45 μm and a ratio of a standard deviation to the average of diameter of primary particles of 0.25 or smaller are added to the mother particles of the toner as an external additive, wherein said inorganic fine particles are particles of barium titanate produced in accordance with an alkoxide process, and wherein an average circularity of the mother particles is determined with respect to particles having a diameter corresponding to the diameter of a circle of 3 μm or greater by using a flow type analyzer of particle images in accordance with the following equation:

average circularity=(length of circumference of a circle having the same area as the projected area of a particle)/(length of circumference of the projected image of the particle), and said roundness of the inorganic fine particles is determined by taking pictures of particles of an outside additive at a magnification of 20,000 using a scanning electron microscope and determining a length of the circumference and the area of 100 particles using software for an image analysis, and calculating the roundness in accordance with the following equation:

$$\text{roundness}=(\text{length of circumference})^2/\{4\pi\times(\text{area})\}.$$

2. The toner for developing electrostatic images according to claim 1, wherein the toner is a non-magnetic single component toner.

3. A process for producing a toner for developing electrostatic images which comprises melt mixing a binder resin and a coloring agent to obtain a mixture, pulverizing the mixture after cooling to obtain a powder material, treating the obtained powder material by heating under a floating condition to obtain rounded particles and removing rough particles and fine particles from the obtained rounded particles by classification to obtain mother particles of the toner having an average circularity of 0.930 to 0.980, and adding to the mother particles of the toner inorganic fine particles having a roundness of 1.00 to 1.30, an average of diameter of primary particles of 0.05 to 0.45 μm and a ratio of a standard deviation to the average of diameter of primary particles of 0.25 or smaller, wherein said inorganic fine particles are particles of barium titanate produced in accordance with an alkoxide process, and wherein an average circularity of the mother particles is determined with respect to particles having a diameter corresponding to the diameter of a circle of 3 μm or greater by using a flow type analyzer of particle images in accordance with the following equation:

average circularity=(length of circumference of a circle having the same area as the projected area of a particle)/(length of circumference of the projected image of the particle), and said roundness of the inorganic fine particles is determined by taking pictures of particles of an outside additive at a magnification of 20,000 using a scanning electron microscope and determining a length of the circumference and the area of 100 particles using software for an image analysis, and calculating the roundness in accordance with the following equation:

$$\text{roundness}=(\text{length of circumference})^2/\{4\pi\times(\text{area})\}.$$

4. The process according to claim 3, wherein, simultaneously with the addition of the inorganic fine particles having a roundness of 1.00 to 1.30, an average of diameter of primary particles of 0.05 to 0.45 μm and a ratio of a standard deviation to the average of diameter of primary particles of 0.25 or smaller, hydrophobic silica is added in an amount such that a ratio of an amount by weight of the hydrophobic silica to an amount by weight of the inorganic fine particles is 0.8 or smaller.

5. The toner according to claim 1, wherein the average circularity of the mother particles is 0.945 to 0.970.

* * * * *